US007093574B2

(12) United States Patent
Oh

(10) Patent No.: US 7,093,574 B2
(45) Date of Patent: Aug. 22, 2006

(54) ROCKER ARM SHAFT FOR AN AUTOMOBILE ENGINE

(75) Inventor: Jae-Ook Oh, Bupyeong-gu (KR)

(73) Assignee: GM Daewoo Auto & Technology, Incheon (KR)

( * ) Notice: Subject to any disclaimer, the term of this patent is extended or adjusted under 35 U.S.C. 154(b) by 0 days.

(21) Appl. No.: 10/506,451

(22) PCT Filed: Mar. 5, 2003

(86) PCT No.: PCT/KR03/00426

§ 371 (c)(1),
(2), (4) Date: Apr. 21, 2005

(87) PCT Pub. No.: WO03/074842

PCT Pub. Date: Sep. 12, 2003

(65) Prior Publication Data

US 2005/0172922 A1 Aug. 11, 2005

(30) Foreign Application Priority Data

Mar. 5, 2002 (KR) ..... 10-2002-0011540

(51) Int. Cl.
*F01L 1/18* (2006.01)

(52) U.S. Cl. ..... 123/90.39; 123/90.19; 123/90.4; 123/90.41; 123/90.61; 403/28; 403/30; 74/559; 74/593

(58) Field of Classification Search ..... 123/90.39, 123/90.61
See application file for complete search history.

(56) References Cited

U.S. PATENT DOCUMENTS 5,107,803 A * 4/1992 Furnivall ..... 123/90.16

FOREIGN PATENT DOCUMENTS

| | | |
|---|---|---|
| JP | 57-145709 | 9/1882 |
| JP | 57-165612 | 10/1982 |
| JP | 59-150908 | 10/1984 |

* cited by examiner

*Primary Examiner*—Thomas Denion

*Assistant Examiner*—Kyle M. Riddle
(74) *Attorney, Agent, or Firm*—Quarles & Brady LLP

(57) ABSTRACT

Disclosed is a rocker arm shaft for an automobile engine, which is effectively capable of offsetting the length change of the rocker arm shaft, which caused by heat. According to an embodiment of the present invention, a rocker arm shaft can be divided into at least two shafts. An elastic member, such as a coil spring, is positioned between the shafts. When the length change of the shafts is changed by heat, the elastic member offsets the changed length of the shafts. The rocker arm shaft is divided into a hollow first shaft and a hollow second shaft. A one end of the second shaft of the rocker arm shaft forms a receiving groove for inserting the elastic member. With this structure, the rocker arm shaft for an automobile engine does not bend nor get twisted by offsetting the changed length of the shafts by means of the elastic member.

4 Claims, 3 Drawing Sheets

ROCKER ARM SHAFT FOR AN AUTOMOBILE ENGINE

TECHNICAL FIELD

The present invention relates to a rocker arm shaft for an automobile engine that may be installed at a base such as a cylinder head of the automobile engine.

BACKGROUND ART

Generally, internal combustion engines, such as multi-cylinder diesel engines, typically include a crankshaft, a camshaft and a rocker arm shaft. The crankshaft is connected with a plurality of piston rods, which in turn are connected with a plurality of corresponding pistons. Reciprocating movement of the pistons within corresponding combustion cylinders causes rotation of the crankshaft.

The crankshaft is typically interconnected with the camshaft via a gear set and thereby rotatably drives the camshaft during operation. The camshaft includes a plurality of cams, with each cam being associated with an inlet valve, and an exhaust valve or a fuel injector valve. More particularly, the rocker arm shaft carries a plurality of rocker arms, with each rocker arm having a roller follower that engages a corresponding cam on the camshaft. Rotation of the camshaft causes oscillatory pivotal movement of the rocker arms around the rocker arm shaft.

The rocker arm shaft is a hollow pipe, and it may be inserted into a plurality of shaft holes formed through the cylinder head. Since fixing caps are threaded into predetermined shaft holes formed at positions adjacent to both ends of the cylinder head, the rocker arm shaft is rigidly fixed to the shaft hole, respectively.

A problem with a conventional rocker arm shaft for the automobile as described above is that the length of the rocker arm shaft may be changed due to thermal expansion. In other words, if a heat is generated during operation of the automobile engine, it is transmitted to the cylinder head, which in turn is transmitted to the rocker arm shaft and thereby the length of the rocker arm shaft is changed. Due to this, the rocker arm shaft may be twisted or be bent within the shaft holes formed at the positions adjacent to the cylinder head. Alternatively, the cylinder head is broken down due to the thermal expansion of the rocker arm shaft, since the rocker arm shaft is fixed in the shaft hole by means of the fixing cap. If thermal expansion of the rocker arm shaft proceeds continuously, both ends of the rocker arm push the fixing caps and thereby the fixing caps may be forcibly released from the shaft holes.

DISCLOSURE OF INVENTION

Therefore, the present invention has been developed to solve the above-mentioned problems. It is an object of the present invention to provide to a rocker arm shaft for an automobile engine capable of effectively offsetting change of length thereof that is caused by heat.

In order to accomplish the above object, the present invention provides a hollow rocker arm shaft for an automobile engine, in which the rocker arm shafts are fitted into a plurality of shaft holes formed in a cylinder head of the automobile engine, and in which fixing caps are threaded into a part of the shaft holes, which are positioned at both ends of the cylinder head, characterized in that:

the rocker arm shaft is divided into at least two shafts, respectively, in which an elastic member is located between the rocker arm shafts, when the length of the rocker arm shafts is changed by heat, and then the elastic member offsets the change of the length.

Preferably, the rocker arm shaft is divided into a first shaft and a second shaft, respectively.

Preferably, a receiving groove for receiving the elastic member is formed at a one end of the second shaft of the rocker arm shafts.

As described above, the rocker arm shaft for the automobile engine according to the present invention can effectively offset change of the length of the first shaft and the second shaft of the rocker arm shaft, which is caused by heat during operation of the automobile engine.

BRIEF DESCRIPTION OF DRAWINGS

Other features and advantages of the present invention will become more apparent from the following description taken in connection with the accompanying drawings, wherein.

BEST MODE FOR CARRYING OUT THE INVENTION

Embodiments

Hereinafter, the rocker arm shaft for an automobile engine according to a preferred embodiment of the present invention will be described in detail with reference to the accompanying drawings.

Figure 1:
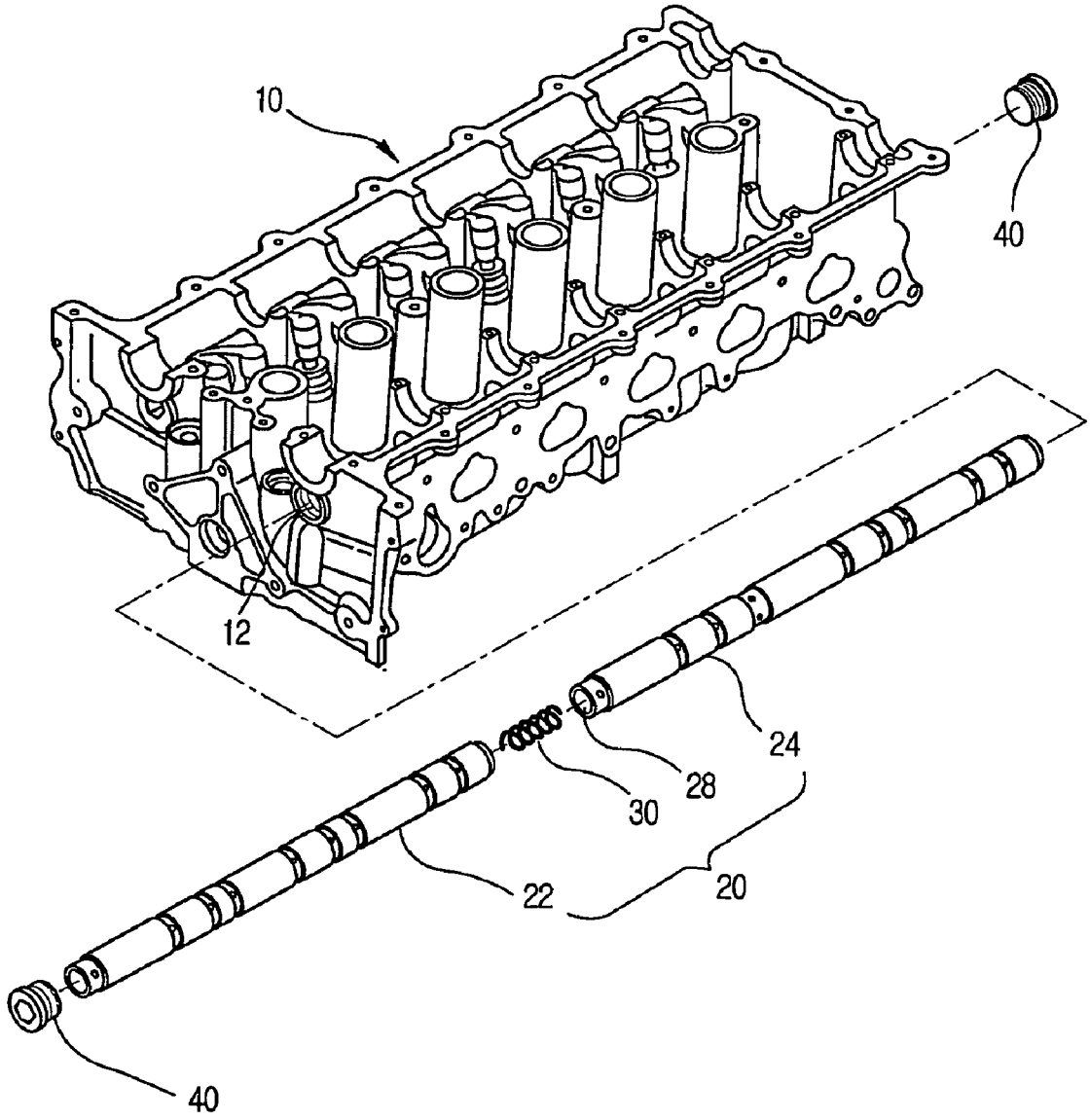
FIG. 1 is an exploded perspective view of a rocker arm shaft for an automobile engine according to a preferred embodiment of the present invention.

The rocker arm shaft for the automobile engine according to the preferred embodiment of the present invention is shown in FIG. 1. Furthermore, the assembled state of the rocker arm shaft is best seen in FIG. 2.

Figure 2:
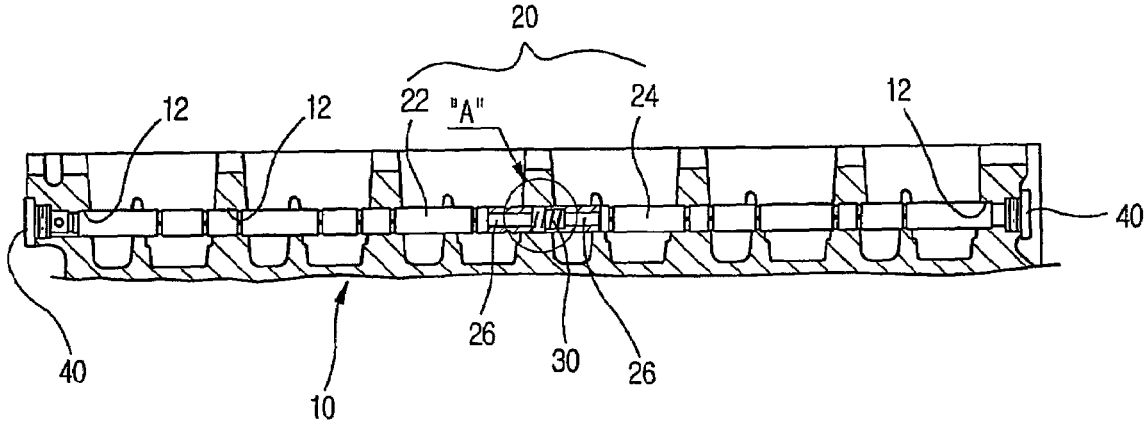
FIG. 2 is a sectional view of the rocker arm shaft for the automobile engine shown in FIG. 1, showing the assembled state of the rocker arm shaft.

As shown in FIGS. 1 and 2, a plurality of shaft holes 12 are formed through an interior of a cylinder head 10 for an automobile engine (not shown) according to the preferred embodiment of the present invention. A screw thread is formed at a radial interior surface of the shaft holes 12 which are located at positions adjacent to both ends of the cylinder head 10.

A through hole 26 is formed through the interior of a rocker arm shaft 20 for the automobile engine according to the preferred embodiment of the present invention. The rocker arm shaft 20 is located in the through hole 26 and thereby it is not exposed to the outside.

The rocker arm shaft 20 may be divided into at least two shafts. Preferably, the rocker arm shaft 20 is divided into a first shaft 22 and a second shaft 24. Alternatively, it may be divided into at least three shafts.

An elastic member 30 comprises a coil spring or a heat resistance elastic rubber. The elastic rubber is fitted into a receiving groove 28 of the second shaft 24. At this time, a part of the elastic member 30 protrudes from the receiving groove 28 of the second shaft 24.

A plurality of fixing caps 40 are threaded into the shaft holes 12 formed at positions adjacent to the both ends of the cylinder head 10, respectively. At this time, the first shaft 22 and the second shaft 24 of the rocker arm shaft 20 are located in the shaft holes 12 of the cylinder head 10, together with the elastic member 30. Under this state, the rocker shaft 20 and the elastic member 30 are not exposed to the outside of the cylinder head 10.

Having described the rocker arm shaft 20 for the automobile engine according to the preferred embodiment of the present invention in detail, the operation of the rocker arm shaft can be understood as follows.

The fixing cap 40 is fitted into the shaft hole 12, which is formed at the utmost rear side among the shaft holes 12 formed in the cylinder head 10. The second shaft 24 of the rocker arm shaft 20 is fitted into the shaft hole 12 of the cylinder head 10. The elastic member 30 is fitted into the shaft hole 12 of the cylinder head 10. The first shaft 22 of the rocker arm shaft 20 is fitted into the shaft hole 12 of the cylinder head 10. At this time, a part of the elastic members 30 is fitted into the receiving hole 28 formed in the through hole 26 of the second shaft 24 of the rocker shaft 20. The fixing cap 40 is threaded into the shaft hole 12, which is formed at the utmost front side among the shaft holes 12 formed in the cylinder head 10. Then, the first shaft 22 and the second shaft 24 of the rocker arm shaft 20 are tightly contacted with the fixing cap 40 that is threaded into the shaft hole 12 of the cylinder head 10 by means of the elastic member 30.

Figure 3:
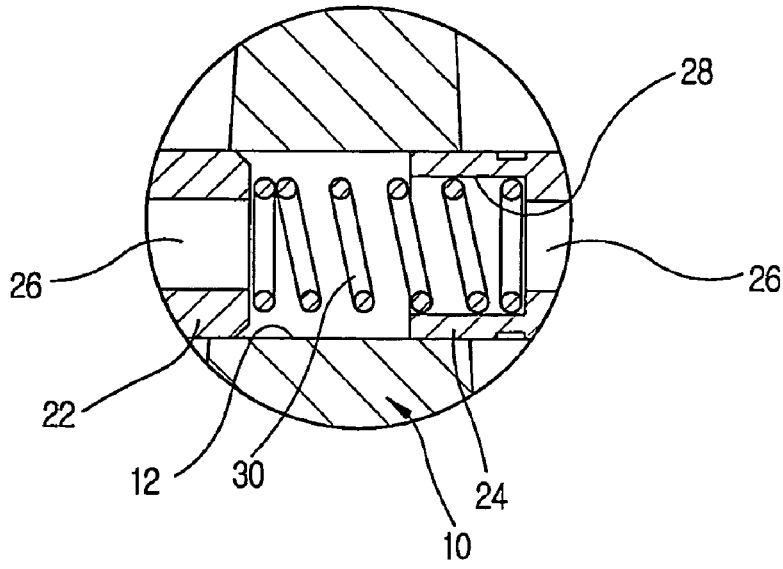
FIG. 3 is an enlarged view of the portion "A" as illustrated in FIG. 2, showing an elastic member before the rocker arm shaft is transformed due to heat.
Figure 4:
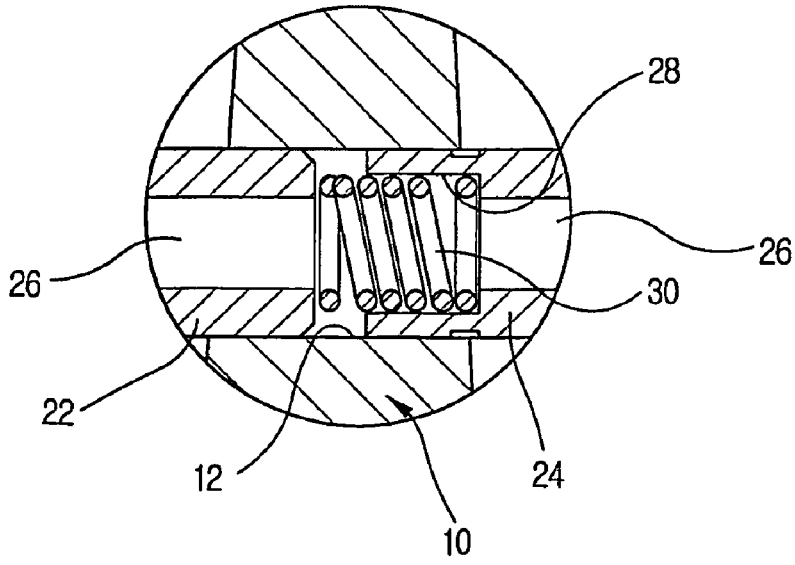
FIG. 4 is a view as in FIG. 3 showing the elastic member after the transformation of the rocker arm shaft due to heat.

FIG. 3 is an enlarged view of the portion "A" as illustrated in FIG. 1, showing an elastic member 30 before the rocker arm shaft 20 is transformed due to heat, and FIG. 4 is a view as in FIG. 3 showing the elastic member 30 after the transformation of the rocker arm shaft 20 due to heat.

Referring to FIGS. 3 and 4, if an automobile engine (not shown) begins to be operated, the cylinder head 10 is heat-expanded by heat generated from the automobile engine during operation thereof. The heat of the cylinder head 10 is transmitted into the first shaft 22 and the second shaft 24 of the rocker arm shaft 20. Then, as shown in FIG. 3, the first shaft 22 and the second shaft 24 of the rocker arm shaft 20 begin to be heat-expanded by heat transmitted from the cylinder head 10. That is, as shown in FIG. 4, the first shaft 22 and the second shaft 24 of the rocker arm shaft 20 push the center portion of the elastic member 30 from both ends of the elastic member 30 so as to compress the elastic member 30 there between.

In other words, if heat generated from the automobile's engine (not shown) is transmitted to the first shaft 22 and the second shaft 24 of the rocker arm shaft 20, the total length of the first shaft 22 and the second shaft 24 is increased. At this time, the elastic member 30 is compressed at the increased length of the first shaft 22 and the second shaft 24 of the rocker arm shaft 20. Accordingly, the first shaft 22 and the second shaft 24 of the rocker arm shaft 20 are neither bent nor twisted.

As described above, since the rocker arm shaft for the automobile engine according to the preferred embodiment of the present invention is neither bent nor twisted, the cylinder head is not damaged, and the fixing cap is not released from the shaft hole. In addition, the elastic member installed between the first shaft and the second shaft offsets the increased length of the first shaft and the second shaft of the rocker arm shaft, which is caused by heat generated during operation of the automobile engine.

While the present invention has been particularly shown and described with reference to particular embodiments thereof, it will be understood by those skilled in the art that various changes in form and details may be effected therein without departing from the spirit and scope of the invention as defined by the appended claims.

The invention claimed is:

1. Hollow rocker arm shafts for an automobile engine, in which the rocker arm shafts are fitted into a plurality of shaft holes formed in a cylinder head of the automobile engine, and in which fixing caps are threaded into a part of the shaft holes, which are positioned at both ends of the cylinder head, characterized in that:

the rocker arm shaft is divided into at least two shafts, respectively, in which an elastic member is located between the rocker arm shafts, when the length of the rocker arm shafts is changed by heat, and then the elastic member offsets the change of the length.

2. The rocker arm shafts for an automobile engine according to claim 1, wherein the rocker arm shaft is divided into a first shaft and a second shaft, respectively.

3. The rocker arm shafts for an automobile engine according to claim 2, wherein a receiving groove for receiving the elastic member is formed at a one end of the second shaft of the rocker arm shafts.

4. The rocker arm shafts for an automobile engine according to claim 3, wherein the elastic member comprises a coil spring.

* * * * *